US008025172B1

(12) United States Patent
Zink

(10) Patent No.: US 8,025,172 B1
(45) Date of Patent: Sep. 27, 2011

(54) HANGING BASKET ACCESSORY FOR AN ABOVE GROUND POOL

(76) Inventor: Dwain A. Zink, Wintersville, OH (US)

( * ) Notice: Subject to any disclaimer, the term of this patent is extended or adjusted under 35 U.S.C. 154(b) by 579 days.

(21) Appl. No.: 12/214,823

(22) Filed: Jun. 23, 2008

Related U.S. Application Data

(60) Provisional application No. 60/936,329, filed on Jun. 21, 2007.

(51) Int. Cl.
*B65D 6/08* (2006.01)
*B65D 25/28* (2006.01)

(52) U.S. Cl. ..... 220/485; 220/756

(58) Field of Classification Search ..... 220/493, 220/485, 482, 480, 476, 676, 720, 756, 751, 220/23.86, 23.83, 483, 481, 494, DIG. 28, 220/757, 762, 764, 660; 4/496, 489; 211/180, 211/181.1; 248/298.1, 274.1
See application file for complete search history.

(56) References Cited

U.S. PATENT DOCUMENTS

| | | | | | |
|---|---|---|---|---|---|
| 414,622 | A | * | 11/1889 | Willits | 217/43 R |
| 714,657 | A | * | 12/1902 | Anderson | 220/485 |
| 744,315 | A | * | 11/1903 | Ecker | 220/7 |
| 1,441,040 | A | * | 1/1923 | Stephenson | 220/480 |
| 1,461,989 | A | * | 7/1923 | Stockham | 220/482 |
| 2,962,273 | A | * | 11/1960 | Moore | 432/261 |
| 3,729,113 | A | * | 4/1973 | Lopatka | 220/480 |
| 4,830,200 | A | * | 5/1989 | Zambano et al. | 211/133.5 |
| 4,893,363 | A | | 1/1990 | Huff | |
| 4,936,480 | A | * | 6/1990 | Apostolo | 220/485 |
| 5,072,828 | A | * | 12/1991 | Irvine | 220/4.33 |
| D342,142 | S | | 12/1993 | Jablonski | |
| 5,590,804 | A | * | 1/1997 | Crum et al. | 220/483 |
| 5,593,122 | A | | 1/1997 | Robertson et al. | |
| 5,810,191 | A | * | 9/1998 | Cornelious | 220/493 |
| 5,860,171 | A | | 1/1999 | Hicks | |
| 5,971,193 | A | | 10/1999 | Sadler et al. | |
| 6,116,438 | A | | 9/2000 | Lovett | |
| 6,209,147 | B1 | | 4/2001 | Wheaton | |
| 6,571,403 | B2 | | 6/2003 | Wheaton | |
| 6,606,996 | B1 | * | 8/2003 | Thornell et al. | 131/241 |
| 6,989,093 | B1 | * | 1/2006 | Greathead | 210/167.19 |
| 2004/0034196 | A1 | * | 2/2004 | Komatsoulis et al. | 530/350 |
| 2005/0011819 | A1 | * | 1/2005 | Gillen et al. | 210/121 |

* cited by examiner

*Primary Examiner* — Mickey Yu
*Assistant Examiner* — Robert J Hicks
(74) *Attorney, Agent, or Firm* — Montgomery Patent & Design; Robert C. Montgomery; Joseph T. Yaksich

(57) ABSTRACT

An open mesh basket designed to be hung on the side of above ground pools for storing pool toys, tools, goggles, and other pool accessories is herein disclosed. The basket takes the form a rectangular mesh box with two (2) long adjustment hooks along side surfaces being slidably received within integral sleeves and secured thereto a desired length with a fastening mechanism. The hooks wrap around and clamp to the upper rail portion of an above-ground pool along an outside edge. The basket further comprises a lockable lid to secure said pool related items therein. The position of the basket allows user's to enjoy easy access thereto pool accessories from both inside and outside the pool. The mesh construction of the basket allows water to quickly drain out and enables included items to dry quickly.

19 Claims, 8 Drawing Sheets

HANGING BASKET ACCESSORY FOR AN ABOVE GROUND POOL

RELATED APPLICATIONS

The present invention was first described in and claims the benefit of U.S. Provisional Patent No. 60/936,329 filed on Jun. 21, 2007, the entire disclosures of which are incorporated herein by reference.

FIELD OF THE INVENTION

The invention generally relates to pool accessory retaining and storage device mountable thereon a pool, comprising an adjustable mesh basket having a first embodiment comprising an open accessible device and a second embodiment comprising a closable and securable device.

BACKGROUND OF THE INVENTION

Very few leisure time activities rival that of spending a warm summer day in a swimming pool. Those who have a back yard above-ground pool are able to enjoy the relaxation and health benefits that are derived from swimming from the comfort of their backyard. Typically, pool users enjoy a wide array of pool accessories to entertain and provide comfort during pool activities. Such accessories range from pool toys, to floatation aids, swimming masks, goggles, cleaning tools, chemicals, and much more. Typically, these objects are stored in a shed, a garage, or just left in the pool. However, these locations present disadvantages from difficult access, clutter, wet floors, and the like. Accordingly, there exists a need for a means by which pool accessories can be kept handy and easily accessible from inside or outside of an above-ground pool but without the disadvantages as described above. The development of the present device herein described fulfills this need.

U.S. Pat. No. D 342,142 issued to Jablonski discloses a pool safety basket. Unfortunately, this design patent does not appear to disclose a device that is similar to in appearance to the disclosed invention nor does the cited patent appear to disclose a device that possesses adjustment hooks and other mechanisms to attach the basket to the upper rail of an above-ground pool nor does it possess a lockable lid.

U.S. Pat. No. 6,571,403 issued to Wheaton discloses a poolside accessory attachment system. Unfortunately, this patent does not disclose a hanging accessory basket.

U.S. Pat. No. 6,209,147 issued to Wheaton discloses an underwater attachment system. Unfortunately, this patent does not disclose a hanging accessory basket.

U.S. Pat. No. 6,116,438 issued to Lovett discloses a pool accessory storage unit. Unfortunately, this patent does not appear to disclose a hanging accessory basket for an above ground pool possesses adjustment hooks and other mechanisms to attach the basket to the upper rail of an above-ground pool nor does it possess a lockable lid.

U.S. Pat. No. 5,971,193 issued to Sadler and Bryan discloses a container for swimming pool maintenance accessories. Unfortunately, this patent does not appear to disclose a hanging accessory basket for an above ground pool possesses adjustment hooks and other mechanisms to attach the basket to the upper rail of an above-ground pool nor does it possess a lockable lid.

U.S. Pat. No. 5,860,171 issued to Hicks discloses a suspended detachable swimming pool accessory. Unfortunately, this patent does not appear to disclose a hanging accessory basket for above-ground pools.

U.S. Pat. No. 5,593,122 issued to Robertson discloses a hanger/hook accessory for pools. Unfortunately, this patent does not appear to disclose a hanging accessory basket for above-ground pools.

U.S. Pat. No. 4,893,363 issued to Huff discloses a hanging wall table for swimming pools. Unfortunately, this patent does not appear to disclose a hanging accessory basket for above-ground pools.

SUMMARY OF THE INVENTION

In view of the foregoing disadvantages inherent in the prior art, it has been observed that there is need for a hanging accessory basket for an above-ground pool.

It is an object of the hanging accessory basket for an above-ground pool to store pool toys, tools, goggles, and other pool accessories.

It is a further object of the hanging accessory basket for above-ground pools to attach to the upper rail portion of the pool which will permit easy access to a user in the pool to the items contained within the hanging accessory basket.

It is another object of the hanging accessory basket for above-ground pools to possess a rectangular open mesh basket to permit drainage of water from items contained therein.

Yet another object of the hanging accessory basket for above-ground pools is to prevent damage to the apparatus from environmental elements and keep children and animals away from contents through the use of a lid and integral locking mechanism.

An aspect of the hanging accessory basket for above-ground pools comprises a rectangular open mesh storage basket to allow for drainage, a pair of adjustable "J"-shaped hooks, a storage basket lid, and a lid locking mechanism. The basket is envisioned to be fabricated of non-corrosive materials and may be provided having a variety of sizes and dimensions.

Another aspect of the hanging accessory basket for above-ground pools comprises a mesh storage basket of varying dimensions based upon particular storage needs. The storage basket comprises an open-top five-sided vessel made using molded plastic mesh or fabricated metal sheet. The storage basket further comprises a plurality of linear frame members comprising a plurality of flat and angle-shaped elements along outer edges being attached thereat intersecting corners to form a box-like structure. The frame provides structural integrity to the apparatus and an inserting attachment means thereto a pair of hook adjustment sleeves.

A further aspect of the hanging accessory basket for above-ground pools comprises adjustment sleeves composed of formed flat metal bars approximately two (2) inches wide and one-half (½) inch thick. The adjustment sleeves comprise low-profile rectangular tubing providing inside dimensions suitable to receive the proximal end portion of an adjustment hook. The apparatus is removably attached thereto the upper rail portion of the above-ground pool by the adjustment hooks which comprise "J"-shaped fixtures made of a durable non-corrosive metal such as stainless steel. The adjustment hooks are particularly sized and contoured to fit against the inner edges of the upper rail portions.

Yet another aspect of the hanging accessory basket for above-ground pools comprises adjustment hooks possessing a protective plastic or rubber coating over the "J"-shaped distal end portions to provide protection from scratching of the upper rails during use. Each adjustment hook provides a lateral direction of adjustment thereto a desired length and is secured thereat said length via a plurality of drilled or molded circular adjusting apertures located along side surfaces of the adjustment hooks and hook adjustment sleeves. The adjusting fasteners comprise common pin-type locking fasteners such as button activated quick-disconnect pins, hitch pins, or the like also constructed out of a durable and non-corrosive metal.

Yet a further aspect of the hanging accessory basket for above ground pools comprises a lid to provide a securing means to the storage basket via a hinge and a locking device. The lid comprises a flat upper panel and three (3) downwardly extending vertical edge portions being approximately one (1) inch high. The lid provides a pivoting attachment means thereto the storage basket via a piano-type hinge device located along an edge of the lid opposite the locking device and extending therebetween the two (2) adjustment hooks. The locking device is preferably located along an edge portion of the lid furthest from the pool and comprises a common latching key-lock or combination locking device.

The hanging accessory basket for above-ground pools, in an alternate embodiment thereof, further comprises the above described apparatus without a lid portion in order to provide a simplified version of the device. The alternate unsecured embodiment comprises similar materials, construction, adjustment, and attachment as the preferred embodiment.

A method for installing and utilizing the hanging accessory basket for above-ground pools may be done by performing the following steps: removing the adjusting fasteners from the adjustment hooks, if previously installed; extending the adjustment hooks in a lateral direction so as to provide clearance over the upper rail portion of the pool; placing the device against the above-ground pool by setting the adjustment hooks at a desired location on the upper rail; readjusting the adjustment hooks within the hook adjustment sleeves in a lateral direction, positioning said adjustment hooks until the storage basket tightly abuts side surfaces of the above-ground pool and the adjustment hooks captivate the upper rail portion; securing the position of the adjustment hooks by inserting the adjusting fasteners therein aligned pairs of adjusting apertures; releasing the locking mechanism; opening the lid; placing pool related equipment and items within the storage basket; closing the lid; securing said lid therewith the locking mechanism; removing pool items as needed using the locking mechanism in an expected manner; removing the device by reversing the steps described above; storing the device during unseasonable months, if desired; and, benefiting from convenient secured storage of pool related equipment and items using the present invention.

A method of installing and utilizing the alternate unsecured embodiment may be achieved in like manner as the preferred embodiment. Access to contained items therein the storage basket may take place in an unsecured manner without needing to open and close the lid during each use.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
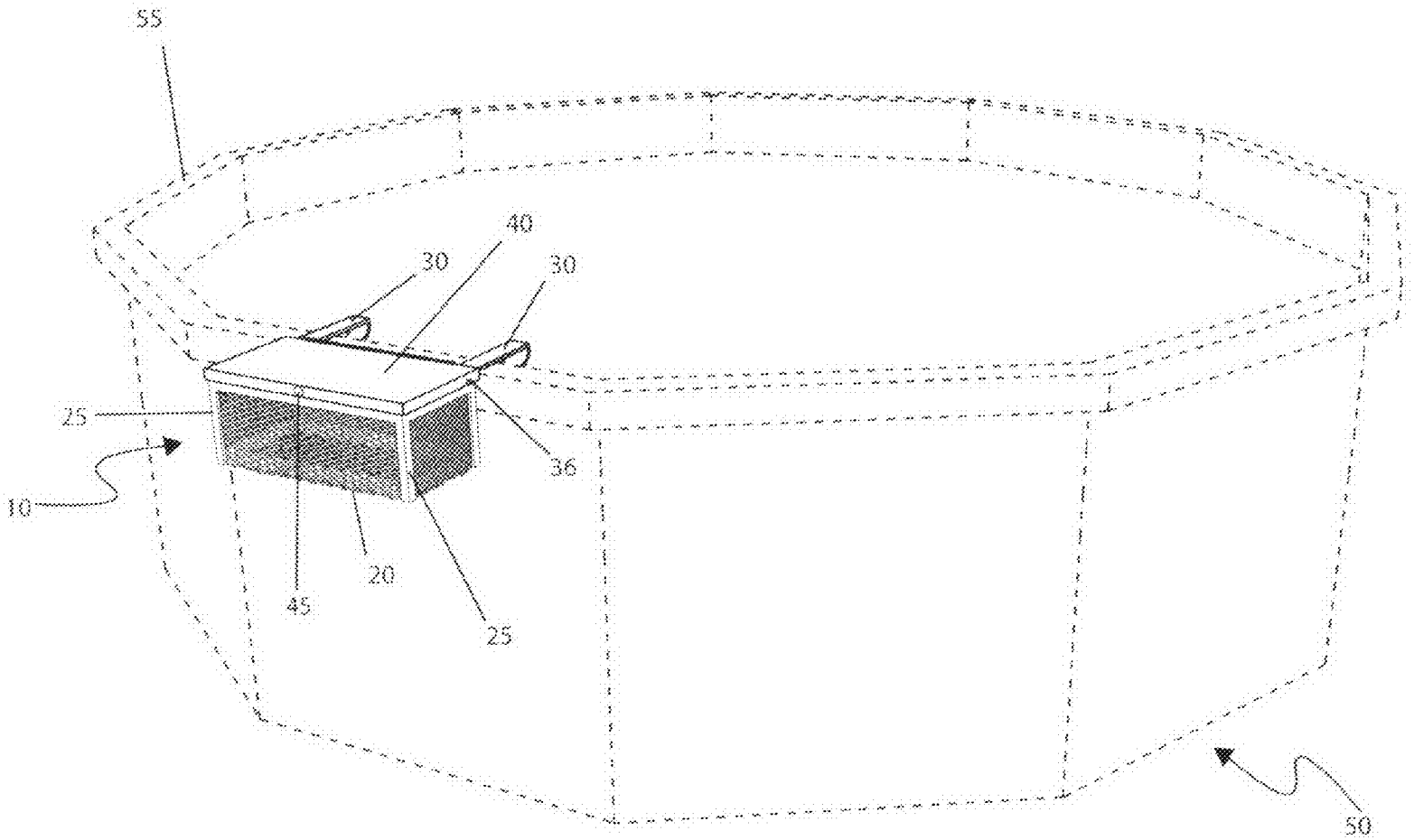
FIG. 1 is an environmental view of a hanging accessory basket 10 for above-ground pool installed upon an above ground pool 50, according to the preferred embodiment of the present invention.
Figure 2:
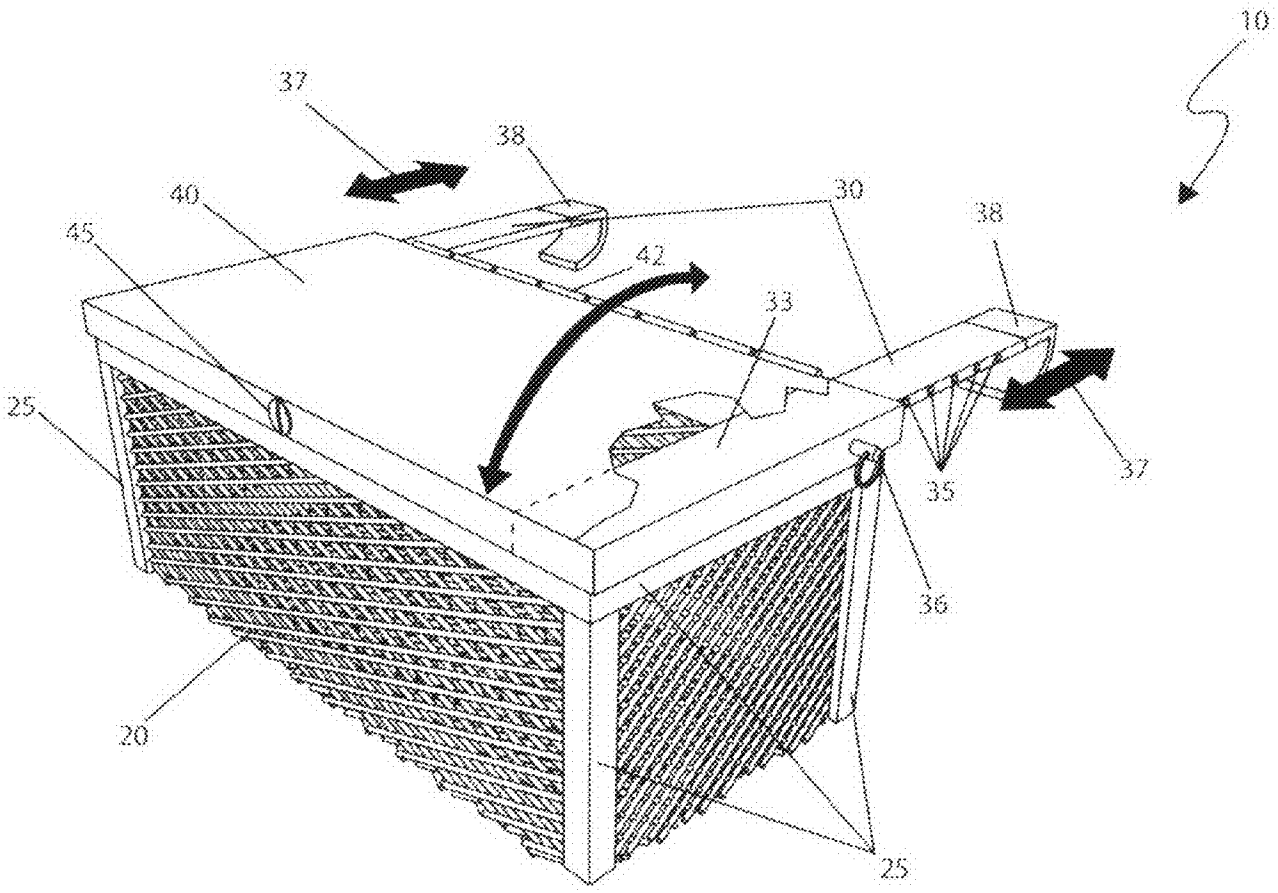
FIG. 2 is a perspective view of a hanging accessory basket 10 for an above-ground pool, according to the preferred embodiment of the present invention.
Figure 3:
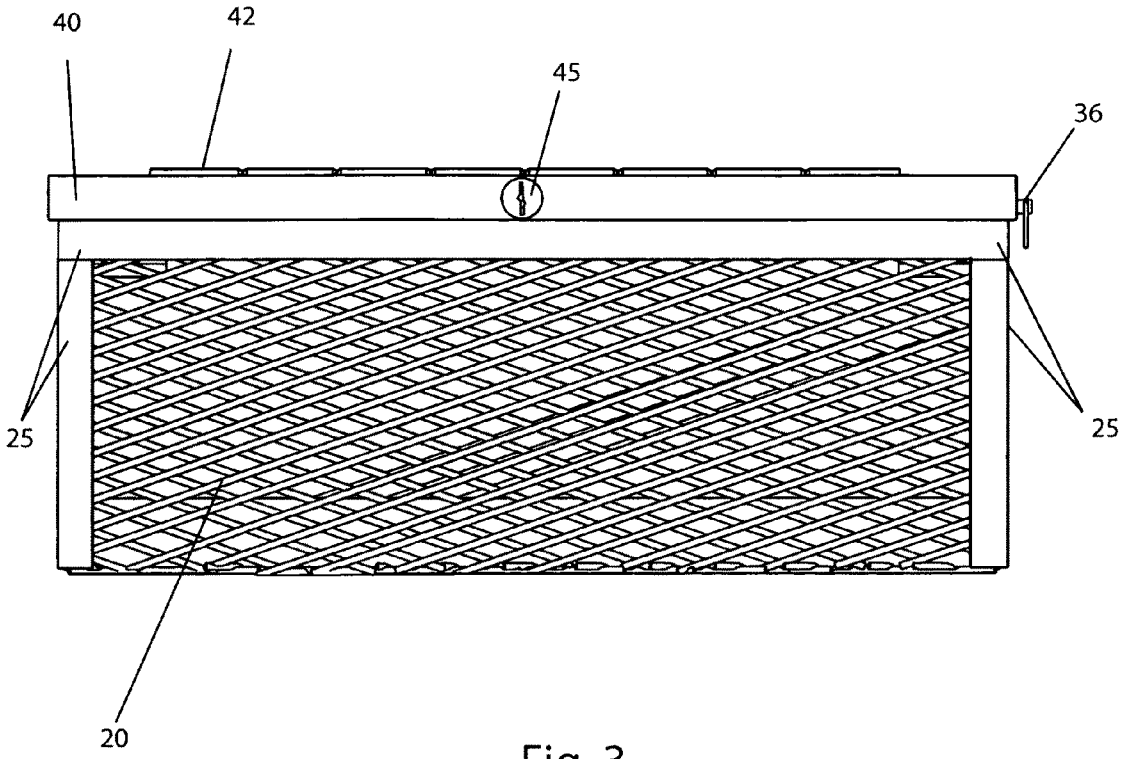
FIG. 3 is a front view of a hanging accessory basket 10 for an above-ground pool, according to the preferred embodiment of the present invention.
Figure 4:
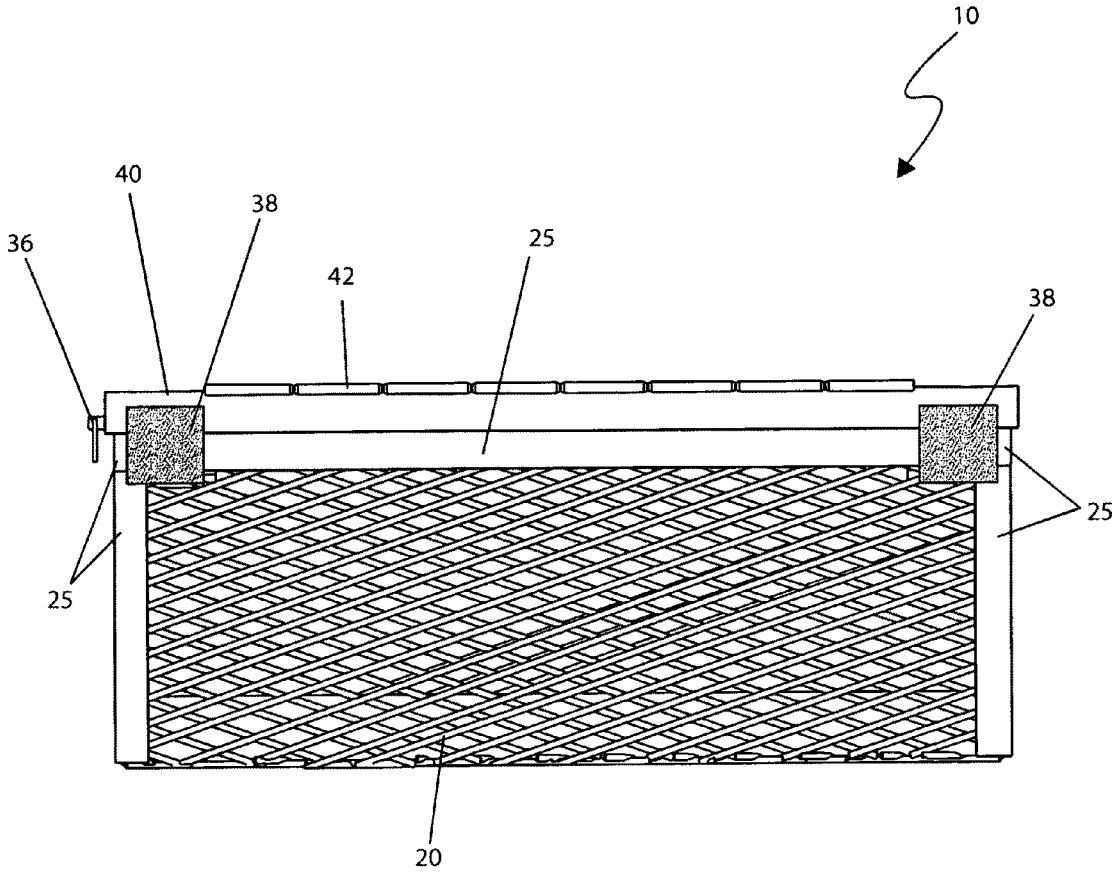
FIG. 4 is a front view of a hanging accessory basket 10 for an above-ground pool, according to the preferred embodiment of the present invention.
Figure 5:
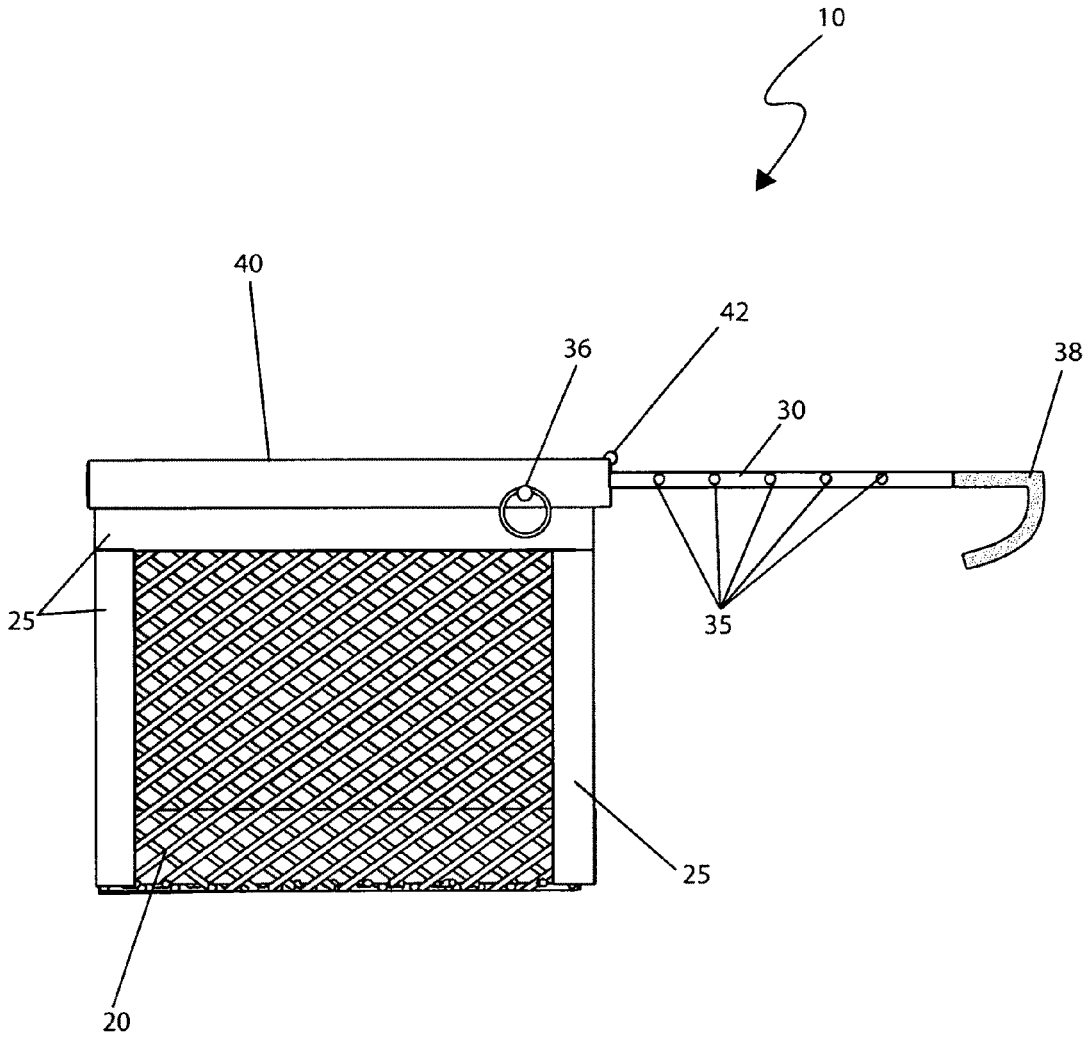
FIG. 5 is a front view of a hanging accessory basket 10 for an above-ground pool, according to the preferred embodiment of the present invention.
Figure 6:
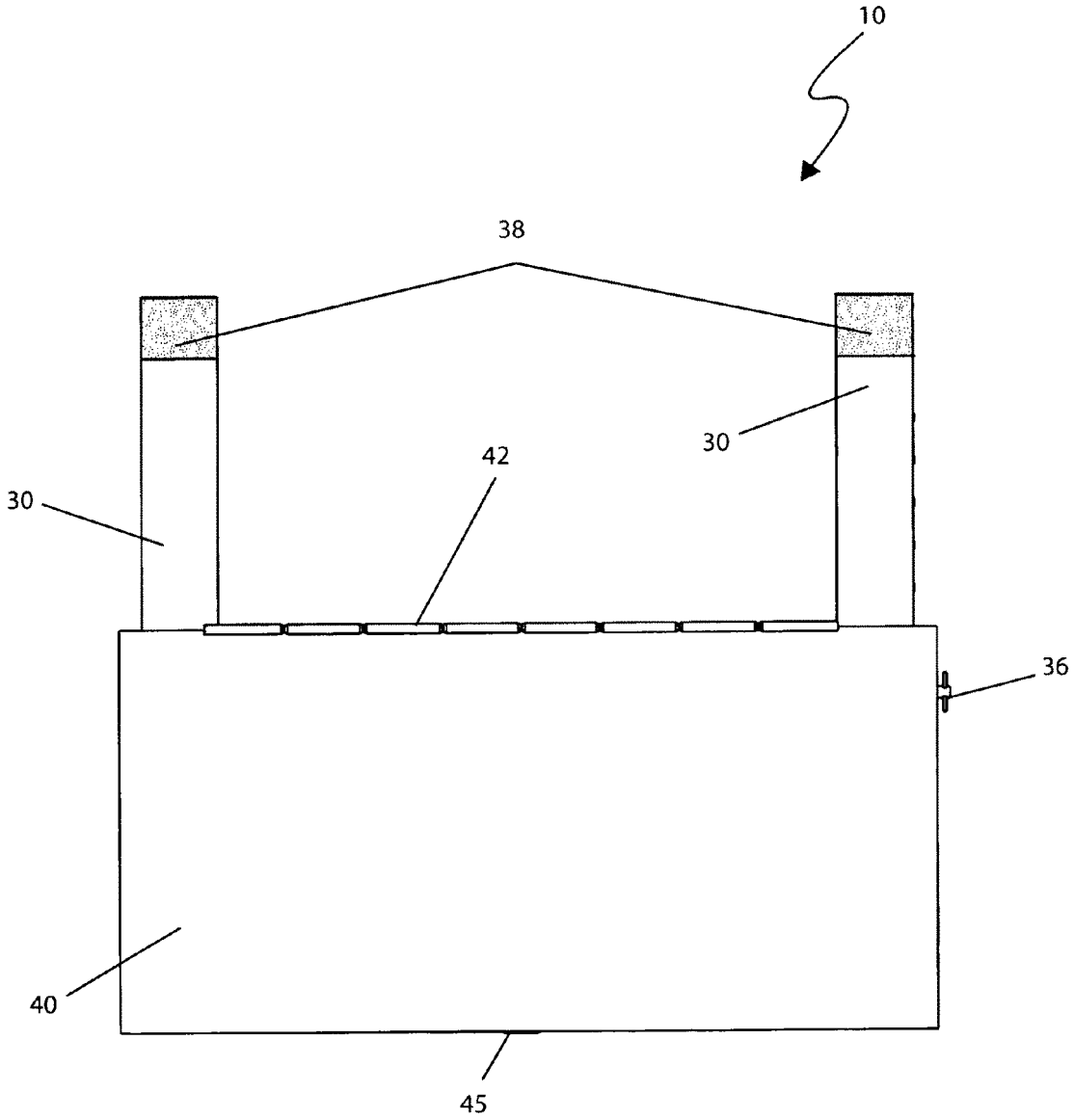
FIG. 6 is a front view of a hanging accessory basket 10 for an above-ground pool, according to the preferred embodiment of the present invention.
Figure 7:
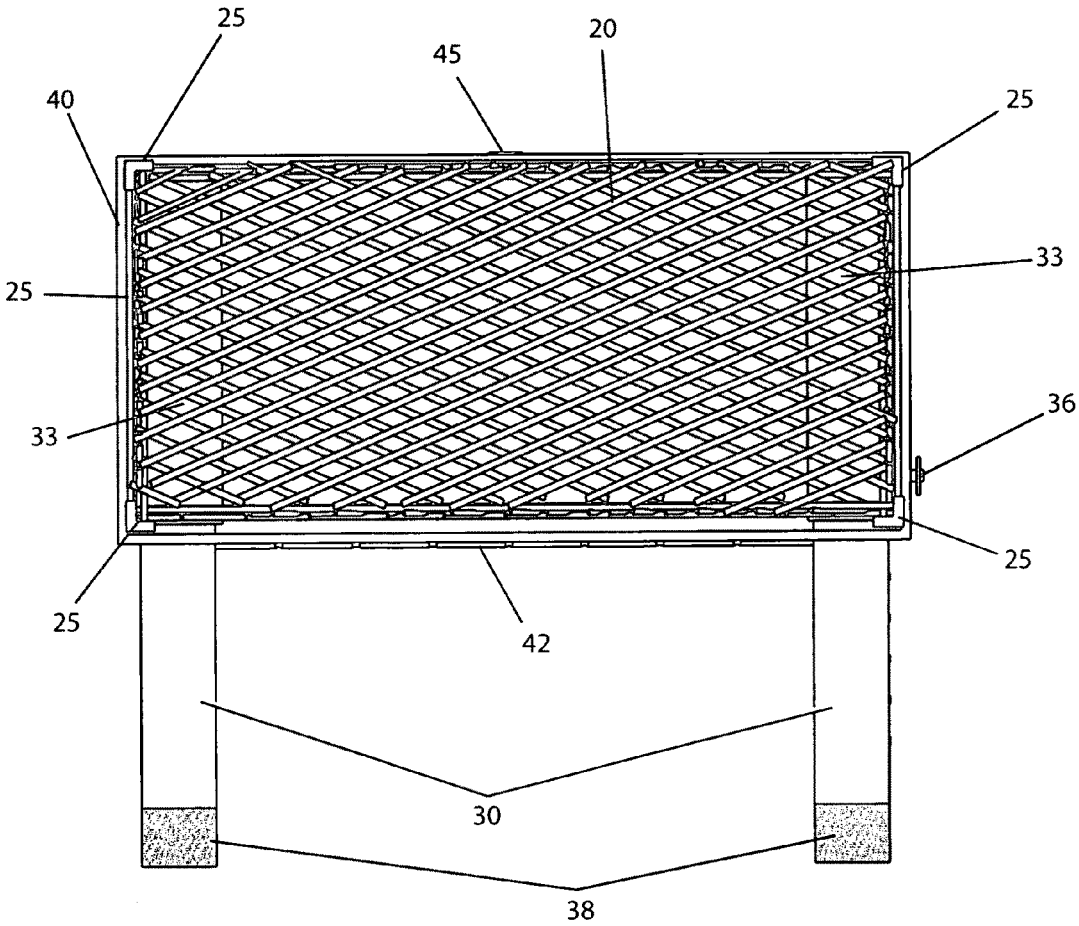
FIG. 7 is a front view of a hanging accessory basket 10 for an above-ground pool, according to the preferred embodiment of the present invention; and, FIG. 8 is a perspective view of an alternate unsecured embodiment 80 of the present invention.

10 hanging accessory basket for an above ground pool
20 storage basket
25 frame
30 adjustment hook
33 hook adjustment sleeve
35 adjusting apertures
36 adjusting fastener
37 direction of adjustment
38 coating
40 storage basket lid
42 hinge
45 locking mechanism
50 above ground pool
55 upper rail
80 alternate unsecured embodiment

DETAILED DESCRIPTION OF THE PREFERRED EMBODIMENT

Figure 8:
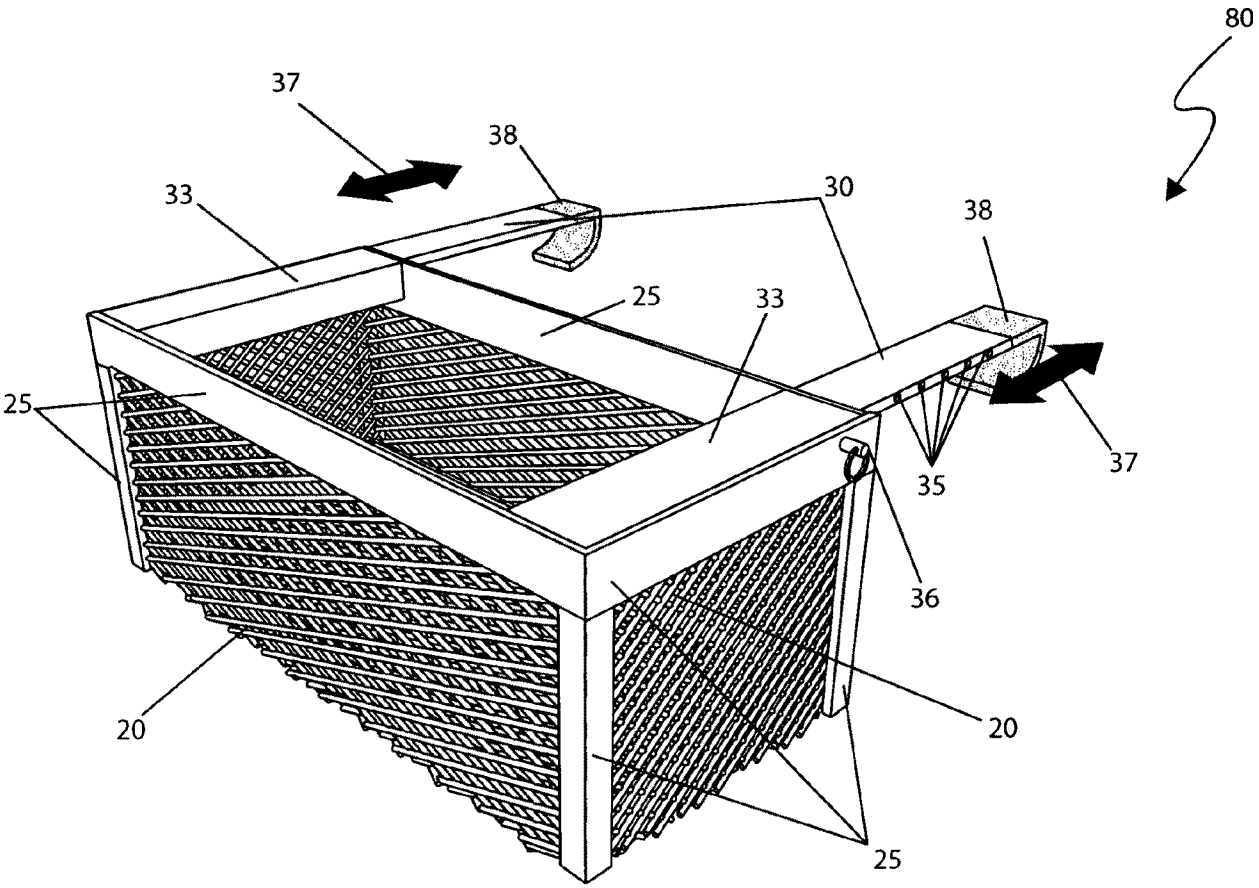

The best mode for carrying out the invention is presented in terms of its preferred embodiment, herein depicted within FIGS. 1 through 7 and in terms of an alternate embodiment, herein depicted within FIG. 8. However, the invention is not limited to the described embodiment and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes a hanging basket device for above-ground pools (herein described as the "device") 10 for storing pool toys, tools, goggles, and other pool accessories. The device 10 is attached thereto an upper rail portion 55 of the pool 50 allowing users easy access thereto pool accessories from both inside and outside the pool. The device 10 comprises a rectangular open mesh storage basket 20 to allow for drainage, a pair of adjustable "J"-shaped hooks 30, a storage basket lid 40, and a lid locking mechanism 45. The lid 40 and integral locking mechanism 45 prevent damage to the apparatus 10 from environmental elements and keep children and animals away from contents. The device 10 is envisioned to be fabricated of non corrosive materials and may be provided having a variety of sizes and dimensions.

Referring now to FIGS. 1 through 7, various views of the device 10 are disclosed according to the preferred embodiment of the present invention. The device 10 provides effective storage of pool items in a mesh storage basket 20 approximately three (3) feet long by one (1) foot high and one (1) foot wide; however, the storage basket 20 may be provided having various dimensions based upon particular storage needs and as such should not be considered a limiting factor of the device 10. The device 10 is envisioned to be fabricated of non corrosive materials such as, but not limited to: plastic, stainless steel, and the like. The device 10 is envisioned being made using common manufacturing processes such as, but not limited to: plastic injection molding technologies, extrusion molding, heat welding, metal welding, soldering, and the like. The storage basket 20 comprises an open-top five-sided vessel made using molded plastic mesh or fabricated metal sheet. The storage basket 20 further comprises a frame 25 having a plurality of linear frame members comprising a plurality of flat and angle-shaped elements along outer edges being attached thereat intersecting corners to form a box-like structure. The frame 25 provides structural integrity thereto the device 10 and an inserting attachment means thereto a pair of hook adjustment sleeves 33 extending horizontally along outside upper edges of the storage basket 20 which extend outwardly toward the pool 50. The adjustment hooks 30 comprise formed flat metal bars approximately two (2) inches wide and one-half (½) inch thick. The adjustment sleeves 33 comprise low-profile rectangular tubing providing inside dimensions suitable to slidingly receive therein a proximal end portion of the adjustment hook 30. The device 10 is removably attached thereto the upper rail portion 55 of the above-ground pool 50 via the adjustment hooks 30 which comprise "J"-shaped fixtures made of a durable non-corrosive metal such as stainless steel at a distal end thereof particularly sized and contoured to fit snugly thereagainst inner edges of said upper rail portions 55. The adjustment hooks 30 further comprise a protective plastic or rubber coating 38 over the "J"-shaped distal end portions which provides protection from scratching of the upper rails 55 during use. Each adjustment hook 30 provides a lateral direction of adjustment 37 thereto a desired length and is secured thereat said length via a plurality of drilled or molded circular adjusting apertures 35 located along side surfaces of the adjustment hooks 30 and hook adjustment sleeves 33. In use, a pair of adjusting fasteners 36 is manually inserted therethrough aligned pairs of adjusting apertures 35, thereby securing the adjustment hooks 30 thereat desired lengths. The adjusting fasteners 36 comprise common pin-type locking fasteners such as button activated quick-disconnect pins, hitch pins, or the like also constructed out of a durable and non-corrosive metal. The lid 40 provides a securing means thereto the storage basket 20 via a hinge 42 and a locking device 45. The lid 40 comprises a flat upper panel and three (3) downwardly extending vertical edge portions being approximately one (1) inch high. The lid 40 provides a pivoting attachment means thereto the storage basket 20 via a piano-type hinge device 42 located along an edge of the lid 40 opposite the locking device 45 and extending therebetween the two (2) adjustment hooks 30. The locking device 45 is preferably located along an edge portion of the lid 40 furthest from the pool 50 and comprises a common latching key-lock or combination locking device.

Referring to FIG. 8, a perspective view of an alternate unsecured embodiment 80, is herein disclosed. The device 10 is illustrated here without a lid portion 40, thereby providing a simplified version of the device 10 and reducing manufacturing costs. The alternate unsecured embodiment 80 comprises similar materials, construction, adjustment, and attachment as the preferred embodiment 10.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by a common user in a simple and effortless manner with little or no training, but most typically is intended for individuals whom own above-ground pools 50 for containing items such as, but not limited to pool toys, flotation aids, swimming masks, cleaning tools, goggles, pool chemicals, and lotions that can be easily accessed from inside or outside of an above-ground pool 50. After initial purchase or acquisition of the device 10, it would be configured as indicated in FIGS. 1 through 7.

The method of installing and utilizing the preferred embodiment of the device 10 may be achieved by performing the following steps: removing the adjusting fasteners 36 therefrom the adjustment hooks 30, if previously installed; extending the adjustment hooks 30 in a lateral direction 37 so as to provide clearance over the upper rail portion 55 of the pool 50; placing the device 10 against the above-ground pool 50 by setting the adjustment hooks 30 at a desired location on the upper rail 55; readjusting the adjustment hooks 30 therewithin the hook adjustment sleeves 33 in a lateral direction 37, positioning said adjustment hooks 30 until the storage basket 20 tightly abuts side surfaces of the above-ground pool 50 and the adjustment hooks 30 captivate the upper rail portion 55; securing the position of the adjustment hooks 30 by inserting the adjusting fasteners 36 therein aligned pairs of adjusting apertures 35; releasing the locking mechanism 45; opening the lid 40; placing pool related equipment and items within the storage basket 20; closing the lid 40; securing said lid 40 therewith the locking mechanism 45; removing pool items as needed using the locking mechanism 45 in an expected manner; removing the device 10 by reversing the steps described above; storing the device 10 during unseasonable months, if desired; and, benefiting from convenient secured storage of pool related equipment and items using the present invention 10.

The method of installing and utilizing the alternate unsecured embodiment 80 may be achieved in like manner as the preferred embodiment 10. Access to contained items therein the storage basket 20 may take place in an unsecured manner without needing to open and close the lid 40 during each use.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A storage device comprising:

a frame comprising a plurality of linear frame elements, further having:

a plurality of flat and angle-shaped elements along outer edges being attached at intersecting corners; and, a pair of mounting sleeves located at opposing parallel horizontal upper outside portions of said frame;

an open-top mesh basket affixed thereto said plurality of linear frame elements; and, a pair of adjustable mounting assemblies for mounting said storage device thereto a support structure;

wherein said frame provides structural integrity to said storage device and an inserting attachment means to said pair of adjustable mounting assemblies therein said pair of mounting sleeves;

wherein said pair of mounting sleeves each comprise a low-profile rectangular tubing providing inside dimensions suitable to slidingly receive therein a proximal end portion of each of said pair of adjustable mounting assemblies;

wherein said mesh basket allows for drainage of water thereout;

wherein said storage device stores and retains accessories and toys commonly associated with swimming pools therein;

wherein said storage device is mounted in a manner providing easy access thereto said accessories and toys.

2. The storage device of claim 1, wherein said pair of adjustable mounting assemblies further comprise:

a pair of adjustment hooks each comprising a flat bar and having a support structure engaging portion thereat distal ends thereof; and, a pair of length securing means;

wherein said pair of adjustment hooks removably attaches said storage device thereto an upper rail portion of a swimming pool;

wherein said support structure engaging portion are each particularly sized and contoured to fit snugly thereagainst inner edges of said upper rail portion; and, wherein each of said pair of adjustment hooks provides a lateral direction of adjustment thereto a desired length.

3. The storage device of claim 2, wherein said pair of length securing means further comprises:

a plurality of drilled or molded circular adjusting apertures located along side surfaces of each of said pair of adjustment hooks and said pair of mounting sleeves;

a pair of adjusting fasteners sized so as to correspondingly engage aligned pairs of adjusting apertures when inserted therethrough;

wherein insertion thereof said pair of adjusting fasteners secures said pair of adjustment hooks thereat said desired length.

4. The storage device of claim 3, wherein said pair of adjusting fasteners comprise locking pins.

5. The storage device of claim 3, further comprising a protective plastic or rubber coating therefor each said support structure engaging portion for providing protection thereto said upper rail portion.

6. The storage device of claim 3, wherein said device is fabricated of non-corrosive materials.

7. The storage device of claim 3, wherein said mesh basket further comprises dimensions of approximately three feet long, one foot high, and one foot wide and said pair of adjustment hooks are each approximately two inches wide and one-half inch thick.

8. The storage device of claim 1, further comprising:

a lid hingedly attached thereto a rear portion of said storage device extending therebetween said pair of mounting sleeves; and, a locking device for securing said lid thereto said storage device.

9. The storage device of claim 8, wherein said pair of adjustable mounting assemblies further comprise:

a pair of adjustment hooks each comprising a flat bar and having a support structure engaging portion thereat distal ends thereof; and, a pair of length securing means;

wherein said pair of adjustment hooks removably attaches said storage device thereto an upper rail portion of a swimming pool;

wherein said support structure engaging portion are each particularly sized and contoured to fit snugly thereagainst inner edges of said upper rail portion; and, wherein each of said pair of adjustment hooks provides a lateral direction of adjustment thereto a desired length.

10. The storage device of claim 9, wherein said pair of length securing means further comprises:

a plurality of drilled or molded circular adjusting apertures located along side surfaces of each of said pair of adjustment hooks and said pair of mounting sleeves;

a pair of adjusting fasteners sized so as to correspondingly engage aligned pairs of adjusting apertures when inserted therethrough;

wherein insertion thereof said pair of adjusting fasteners secures said pair of adjustment hooks thereat said desired length.

11. The storage device of claim 10, wherein said pair of adjusting fasteners comprise locking pins.

12. The storage device of claim 10, further comprising a protective plastic or rubber coating therefor each said support structure engaging portion for providing protection thereto said upper rail portion.

13. The storage device of claim 10, wherein said lid comprises a flat upper panel and three downwardly extending vertical edge portions being and said locking device is located along a front edge portion of said lid and securely engages a corresponding latching assembly located thereat a front portion thereof said mesh basket.

14. The storage device of claim 10, wherein said device is fabricated of non-corrosive materials.

15. The storage device of claim 10, wherein said mesh basket further comprises dimensions of approximately three feet long, one foot high, and one foot wide, said pair of adjustment hooks are each approximately two inches wide and one-half inch thick, and said downwardly extending vertical edge portions of said lid are each approximately one inch high.

16. A storage device comprising:

a frame comprising a plurality of linear frame elements, further comprising:

a plurality of flat and angle-shaped elements along outer edges being attached thereat intersecting corners; and, a pair of mounting sleeves located at opposing parallel horizontal upper outside portions thereof said frame;

an open-top mesh basket affixed thereto said plurality of linear frame elements; and, a pair of adjustable mounting assemblies for mounting said storage device thereto a support structure, further comprising:

a pair of adjustment hooks each comprising a flat bar and having a support structure engaging portion thereat distal ends thereof;

a plurality of circular adjusting apertures located along side surfaces of each of said pair of adjustment hooks and said pair of mounting sleeves;

a pair of adjusting fasteners sized so as to correspondingly engage aligned pairs of adjusting apertures when inserted therethrough; and, a protective plastic or rubber coating therefor each said support structure engaging portion for providing protection thereto said upper rail portion;

a lid hingedly attached thereto a rear portion of said storage device extending therebetween said pair of mounting sleeves, comprising a flat upper panel and three (3) downwardly extending vertical edge portions; and, a locking device for securing said lid thereto said storage device located along a front edge portion of said lid and securely engaging a corresponding latching assembly located thereat a front portion thereof said mesh basket;

wherein said frame provides structural integrity thereto said storage device and an inserting attachment means thereto said pair of adjustable mounting assemblies therein said pair of mounting sleeves;

wherein said pair of mounting sleeves each comprise a low-profile rectangular tubing providing inside dimensions suitable to slidingly receive therein a proximal end portion of each of said pair of adjustable mounting assemblies;

wherein said mesh basket allows for drainage of water thereout;

wherein said storage device stores and retains accessories and toys commonly associated with swimming pools therein;

wherein said pair of adjustment hooks removably attaches said storage device thereto an upper rail portion of a swimming pool;

wherein said support structure engaging portion are each particularly sized and contoured to fit snugly thereagainst inner edges of said upper rail portion;

wherein insertion thereof said pair of adjusting fasteners secures said pair of adjustment hooks thereat said desired length;

wherein each of said pair of adjustment hooks provides a lateral direction of adjustment thereto a desired length; and, wherein said storage device is mounted in a manner providing easy access thereto said accessories and toys.

17. The storage device of claim 16, wherein said pair of adjusting fasteners comprise locking pins.

18. The storage device of claim 16, wherein said device is fabricated of non-corrosive materials.

19. The storage device of claim 16, wherein said mesh basket further comprises dimensions of approximately three feet long, one foot high, and one foot wide, said pair of adjustment hooks are each approximately two inches wide and one-half inch thick, and said downwardly extending vertical edge portions of said lid are each approximately one inch high.

* * * * *